US010969073B2

(12) United States Patent
Jiang

(10) Patent No.: US 10,969,073 B2
(45) Date of Patent: Apr. 6, 2021

(54) COLOR TEMPERATURE COMPENSATION SYSTEM AND METHOD FOR STAGE LIGHT

(71) Applicant: Guangzhou Haoyang Electronic Co., Ltd., Guangdong (CN)

(72) Inventor: Weikai Jiang, Guangdong (CN)

(73) Assignee: Guangzhou Haoyang Electronic Co., Ltd.

( * ) Notice: Subject to any disclaimer, the term of this patent is extended or adjusted under 35 U.S.C. 154(b) by 0 days.

(21) Appl. No.: 16/848,295

(22) Filed: Apr. 14, 2020

(65) Prior Publication Data

US 2020/0240603 A1 Jul. 30, 2020

Related U.S. Application Data

(63) Continuation of application No. PCT/CN2018/103300, filed on Aug. 30, 2018.

(30) Foreign Application Priority Data

Oct. 19, 2017 (CN) ..... 201710978628.2

(51) Int. Cl.

| | |
|---|---|
| ***F21S 10/02*** | (2006.01) |
| ***F21V 14/00*** | (2018.01) |
| *F21Y 115/10* | (2016.01) |
| *F21W 131/406* | (2006.01) |

(52) U.S. Cl.

CPC ..... *F21S 10/026* (2013.01); *F21V 14/006* (2013.01); *F21W 2131/406* (2013.01); *F21Y 2115/10* (2016.08)

(58) Field of Classification Search

CPC ..... F21S 10/026; F21V 9/40; F21V 17/02; F21V 14/06; F21W 2131/406; F21W 2131/105

See application file for complete search history.

(56) References Cited

U.S. PATENT DOCUMENTS 7,972,028 B2 7/2011 Durand et al.
8,596,824 B2 * 12/2013 Calmes ..... F21V 9/40 362/278

FOREIGN PATENT DOCUMENTS

| | | |
|---|---|---|
| CN | 103196100 A | 7/2013 |
| CN | 203549693 U | 4/2014 |
| CN | 104913265 A | 9/2015 |
| CN | 107842815 A | 3/2018 |
| CN | 207539816 U | 6/2018 |

OTHER PUBLICATIONS

International Search Report for PCT/CN2018/103300 dated Dec. 5, 2018, 5 pages.

* cited by examiner

*Primary Examiner* — Robert J May
(74) *Attorney, Agent, or Firm* — Lerner, David, Littenberg, Krumholz & Mentlik, LLP

(57) ABSTRACT

A color temperature compensation system comprises a light source, a dimming element for dimming the light source, a color temperature compensation sheet for performing color temperature compensation on light output from the dimming element, in which there are different changes of color value on the color temperature compensation sheet, and a driving mechanism for controlling the movement of the color temperature compensation sheet and driving the color temperature compensation sheet to switch in and switch out of a light path.

14 Claims, 4 Drawing Sheets

COLOR TEMPERATURE COMPENSATION SYSTEM AND METHOD FOR STAGE LIGHT

CROSS REFERENCE TO RELATED APPLICATIONS

The present application is a continuation of International Application No. PCT/CN2018/103300, filed on Aug. 30, 2018, which claims priority from Chinese Patent Application No. 201710978628.2 filed on Oct. 19, 2017, all of which are hereby incorporated herein by reference.

TECHNICAL FIELD

The present invention relates to the technical field of stage lights, and more particularly to a color temperature compensation system and method for a stage light.

BACKGROUND

In order to enrich the stage art effect and heighten atmosphere, it is necessary for stage lights to make many effects to meet the requirements of stage lighting engineers, such as a color effect, a pattern effect, a prism effect, a flame effect, a beam effect, beam amplification and de-magnification effects, and a light dimming effect. The dimming function of the stage light is an important function in the stage scenario, and is mainly used to adjust the luminance of the stage light from 0 to 100%. A dimming sheet used in the existing stage light technologies directly seats in the front of a light source to perform dimming by shielding the light emitting area of the light source, or the stage light with an LED light source directly uses electronic dimming, which can basically meet the requirements of general stage scenarios; however, in the dimming process of this dimming structure, the color temperature of light changes with the luminance of the light, and consequently, the atmosphere of the stage scenario does not meet the requirements of the lighting engineers. With the improvement of the light quality of stage lights in the stage scenario, more and more lighting engineers require that the quality of light cannot be degraded in the dimming process, and particularly require that, this important indicator, namely, the color temperature of the light, should remain basically consistent in the dimming process.

SUMMARY OF THE INVENTION

The present invention provides a color temperature compensation system for a stage light to overcome some disadvantages of the prior art, which is simple in structure and convenient to operate When a light source emits light with different luminance, the color temperature of the light can be compensated by the system according to the present invention in real time, so that the color temperature of the light can remain basically consistent in a dimming process, the stability of the light output quality of the light is thus improved.

According to the invention, the color temperature compensation system for a stage light comprises a light source and a dimming element for dimming the light source, and further comprises a color temperature compensation sheet for performing color temperature compensation on light output from the dimming element, and a driving mechanism for controlling the movement of the color temperature compensation sheet, wherein there are different changes of color value on the color temperature compensation sheet, and the driving mechanism drives the color temperature compensation sheet to switch in and switch out of a light path, thus implementing color temperature compensation.

After the luminance of the light emitted from the light source is adjusted by the dimming element, the color temperature compensation sheet performs color temperature compensation During color temperature compensation, the displacement of the color temperature compensation sheet switching in and switching out of the light path is a distance of the color temperature compensation sheet getting in and out of the light path relative to the optical axis.

In such configuration, the system comprises a color temperature compensation sheet and a driving mechanism. The driving mechanism is used to control the color temperature compensation sheet to switch in and switch out of the light path to compensate, in real time, the color temperature of the light with different luminance emitted by the light source, so that the color temperature of the light can remain basically consistent in a dimming process, the stability of the light output quality of the light is thus improved. And such configuration is simple in structure and convenient to operate.

Preferably, the driving mechanism comprises a motor and a belt drive element driven by the motor, and the color temperature compensation sheet is arranged on a conveyor belt of the belt drive element. The color temperature compensation sheet comprises a color temperature compensation region and a fixing end which is used to fix the color temperature compensation sheet to the conveyor belt, when the motor drives the belt drive element to rotate, the conveyor belt will rotate and drive the color temperature compensation sheet to switch in and switch out of the light path, thus implementing color temperature compensation. Such a driving manner is simple and easy to implement. The color temperature compensation sheet can be switched in and switched out of the light path through forward and reverse rotation of the motor, which is easy to control. Further preferably, the belt drive element further comprises a driving wheel and a driven wheel which are sleeved on both ends of the conveyor belt. The motor can drive the driving wheel to rotate. Specifically, a drive rotary shaft of the motor is connected to the driving wheel. The color temperature compensation system further comprises an auxiliary sliding element which is slidably connected to the color temperature compensation sheet. When the conveyor belt drives the color temperature compensation sheet to move, the color temperature compensation sheet can slide on the auxiliary sliding element, so that the stability of the movement of the color temperature compensation sheet can be improved, and the color temperature compensation effect thus can be further ensured.

Preferably, at least one color temperature compensation sheet is provided. Further preferably, two color temperature compensation sheets are provided. It is configured that the two color temperature compensation sheets switch in and switch out of the light path through moving toward or away from each other by means of the driving mechanism. Such configuration facilitates increasing the switch-in and switch-out speed of the color temperature compensation sheet compared to the case of one color temperature compensation sheet alone. Preferably, the number of each of the motor and the belt drive element is only one, and the two color temperature compensation sheets are respectively arranged on both sides of the conveyor belt. Such configuration is convenient for the two color temperature compensation sheets to move at the same speed, and can also simplify the driving mechanism, thereby facilitating control and also reducing costs; or the number of each of the motors and the belt drive element is two, and the two color temperature compensation sheets are respectively arranged on the two conveyor belts.

Preferably, an installation position of the two color temperature compensation sheets is configured with a height difference, and the two color temperature compensation sheets can partially overlap when the two color temperature compensation sheets move toward each other. Compared with a case where the two color temperature compensation sheets can only be in contact and cannot overlap, partial overlapping of the two color temperature compensation sheets enables color temperature of light at any position on the light path to be compensated, which can avoid a case where the color temperature of light at the position of a contact line cannot be compensated when the two color temperature compensation sheets are in contact in parallel, such case can further affect the color temperature compensation effect.

Preferably, the color temperature compensation sheet uses the same hue as a reference color, and performs color temperature by increasing or decreasing compensation on the light passing therethrough based on a change of color value of the reference color. Further preferably, the color temperature compensation sheet performs color temperature by increasing compensation on the light passing therethrough based on a change in the color value of blue, or the color temperature compensation sheet performs color temperature by decreasing compensation on the light passing therethrough based on a change in the color value of yellow.

Preferably, the color temperature compensation sheet is perpendicular to an optical axis.

Preferably, the change in the color value of the color temperature compensation sheet is a uniform change to simplify the design and production process of the color temperature compensation sheet; or the change in the color value of the color temperature compensation sheet varies according to a color temperature compensation value required by the light source under different luminance conditions; and the driving mechanism can control, according to a dimming speed, the moving speed of the color temperature compensation sheet during the color temperature compensation sheet switch-in and switch-out of the light path.

Preferably, the light source is a traditional light source, the dimming element of the traditional light source is a dimming sheet arranged between the color temperature compensation sheet and the light source, and the dimming sheet performs shielding dimming on the light passing therethrough by means of switch-in and switch-out of the light path; or the light source can be an LED light source, and the dimming element of the LED light source uses electronic dimming. The traditional light source includes non-LED lights and non-laser lights. Further preferably, when the light source is a traditional light source, the dimming sheet and the color temperature compensation sheet are arranged on the same driving mechanism; and the displacement of the color temperature compensation sheet switching in the light path is less than the displacement of the dimming sheet switching in the light path, and the displacement is correspondingly a distance of the color temperature compensation sheet or the dimming sheet getting in and out of the light path relative to the optical axis. Such configuration can save the internal space of the stage light and can switch the color temperature compensation sheet and the dimming sheet in and out of the light path in a matching manner.

Preferably, the system further comprises a reflector cup, and the color temperature compensation sheet is arranged at a position between the focus on which the light source is first focused and the reflector cup. Such configuration can avoid optical imaging of the color temperature compensation sheet. Further preferably, in order to reduce the size of the color temperature compensation sheet, the color temperature compensation sheet is arranged at a position close to the light source and away from the focus on which the light source is first focused.

The present invention also provides a color temperature compensation method for a stage light, which uses the above-mentioned color temperature compensation system for a stage light and comprises the following steps:

S1. selecting the model of a stage light with a color temperature to be compensated;

S2. testing a change in the luminance of output light in a dimming process of the stage light and testing the corresponding change in color temperature according to the luminance of output light, and recording a maximum value by which the color temperature deviates from a standard color temperature, namely, a maximum color temperature compensation value; and measuring the luminance and color temperature in the dimming process of the stage light by means of an illuminometer;

S3. designing a color value change range of the color temperature compensation sheet according to the maximum color temperature compensation value and a relationship between the change in the color temperature and the change in the luminance of output light and, and selecting a reference color according to required increase or decrease compensation of color temperature;

S4. designing a spatial position of the color temperature compensation sheet on a light path according to a spatial structure of the stage light and determining the size of the color temperature compensation sheet, and designing a change in the color value on the color temperature compensation sheet according to the size, the number, the color value change range and the reference color of the color temperature compensation sheet;

S5. determining a color temperature compensation value required under different luminance conditions according to the relationship between the change in the color temperature and the change in the luminance of output light, and determining a displacement value of the color temperature compensation sheet switching in and switching out of the light path under different luminance conditions according to the change in the color value and the size of the color temperature compensation sheet, and the spatial position of the color temperature compensation sheet in the light path; and S6. the driving mechanism controlling the movement of color temperature compensation sheet according to the displacement value of the color temperature compensation sheet under different luminance conditions.

The factors affecting the color temperature include light path focusing, amplification, lens refraction, etc. in addition to a change in the luminance of a light source. Therefore, the change in color value of the color temperature compensation sheet needs to be designed based on specific test data, there is no uniform calculation formula, and models of stage lights also need to be determined.

When the color temperature compensation method is used to perform color temperature compensation on the stage light, due to the impact of the color temperature compensation sheet on luminance, the color temperature compensation value can be appropriately reduced within a luminance standard range, and it is preferable that the luminance of output light reaches required luminance.

Compared with the prior art, the present invention can achieve some beneficial effects. The present invention relates to a color temperature compensation system for a stage light comprising a color temperature compensation sheet and a driving mechanism, in which the driving mechanism is used to control the switch-in and switch-out of the color temperature compensation sheet to compensate, in real time, the color temperature of the light of different luminance emitted by the light source, so that the color temperature of the light can remain basically consistent in a dimming process, the stability of the light output quality of the light is thus improved. And such system is simple in structure and convenient to operate.

DETAILED DESCRIPTION OF EMBODIMENTS

Figure 1:
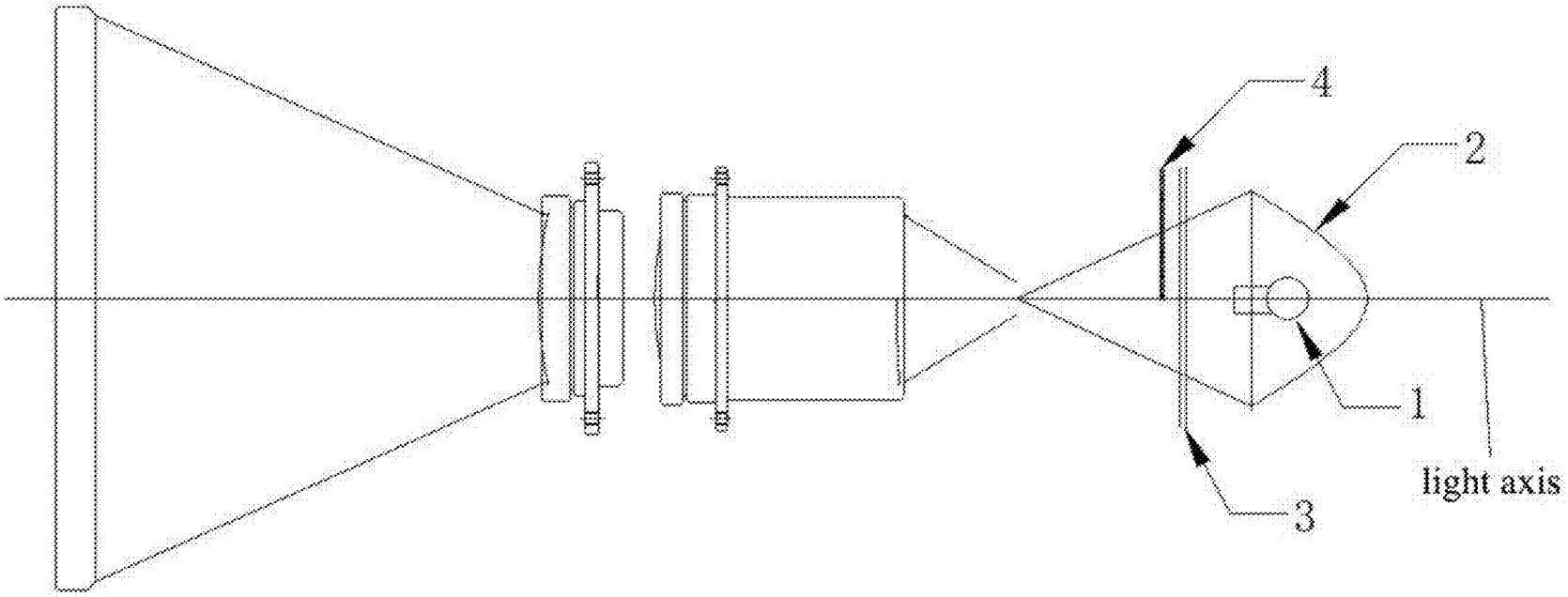
FIG. 1 is a simplified structural diagram of a light path of a color temperature compensation system for a stage light according to an Embodiment.

The present invention will be further described below in conjunction with specific embodiments. The drawings are used for illustrative purposes only, are merely schematic diagrams, rather than pictures of a real object, and are not to be construed as limiting this patent. In order to better illustrate the embodiments of the present invention, some components will be omitted, scaled up or scaled down in the drawings, which does not represent the size of the actual product. For those skilled in the art, it would have been appreciated that some well-known structures in the accompanying drawings and the illustration thereof could be omitted.

The same or similar reference numerals in the accompanying drawings of the embodiments of the present invention correspond to the same or similar components. In the description of the present invention, it is to be understood that if the orientation or positional relationship indicated by the terms "upper", "lower", "left", "right", etc. is based on the orientation or positional relationship shown in the drawings, which is intended to facilitate describing the present invention and simplifying the description only, rather than indicating or implying that a device or an element referred to must have a particular orientation or be configured and operated in a particular orientation, and therefore the terms used to describe the positional relationship in the drawings are for illustrative purposes only and are not to be construed as limiting the scope of this patent, and for those skilled in the art, the specific meaning of the above terms may be understood according to specific conditions.

Embodiment I

Figure 2:
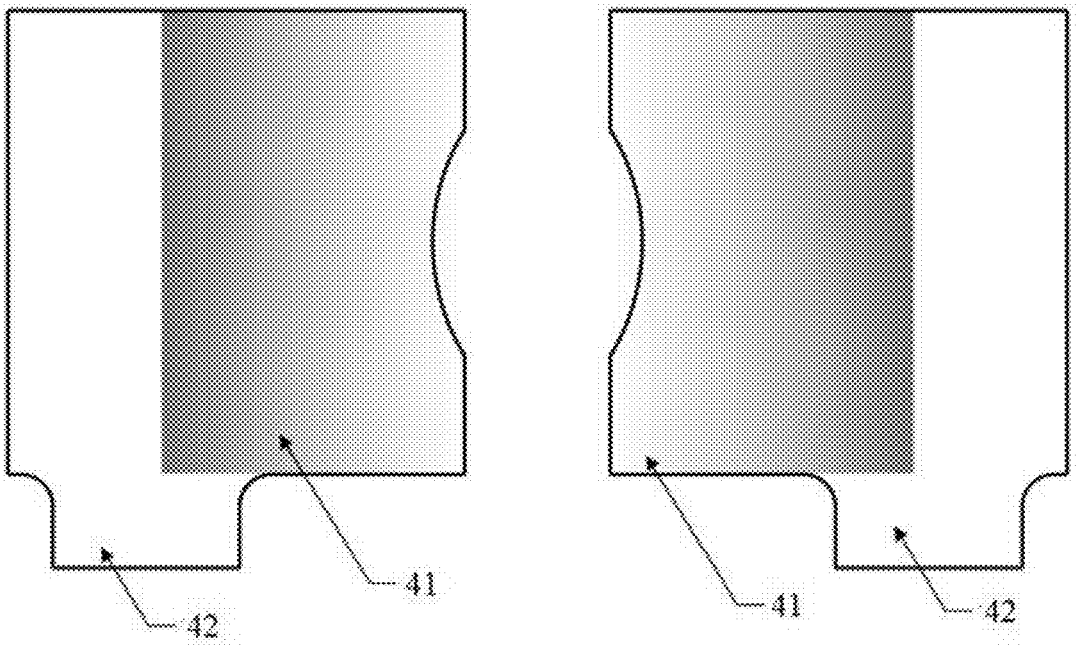
FIG. 2 is a schematic structural diagram of a color temperature compensation sheet according to the Embodiment.
Figure 3:
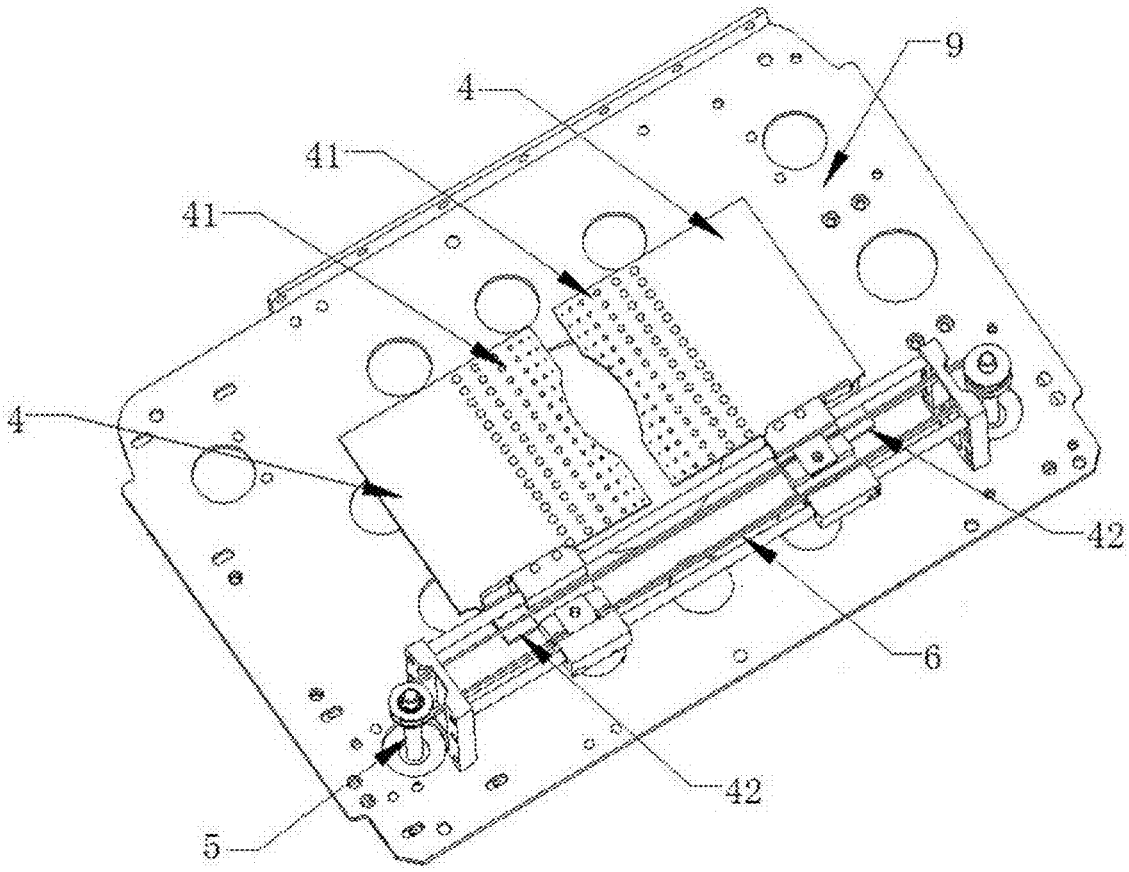
FIG. 3 is a schematic diagram of a connection between the color temperature compensation sheet and a driving mechanism according to the Embodiment.

In this embodiment, as shown in FIGS. 1 to 3, the color temperature compensation system for a stage light comprises a light source 1 and a dimming element 3 for dimming the light source 1, and further comprises a color temperature compensation sheet 4 for performing color temperature compensation on the light output from the dimming element 3, and a driving mechanism 9 for controlling the movement of the color temperature compensation sheet 4, wherein there are different changes in color value on the color temperature compensation sheet 4, and the driving mechanism 9 drives the color temperature compensation sheet 4 to switch in and switch out of a light path so as to implement color temperature compensation.

In this embodiment, the light source 1 is a traditional light source, the traditional light source includes non-LED lights and non-laser lights, the dimming element 3 of the traditional light source is a dimming sheet, the dimming sheet is arranged between the color temperature compensation sheet 4 and the light source 1, and the dimming sheet performs shielding dimming on the light passing therethrough by means of switch-in and switch-out of the light path; the dimming sheet and the color temperature compensation sheet 4 are arranged on the same driving mechanism 9, so that the internal space of the stage light can be saved and the color temperature compensation sheet 4 and the dimming sheet can switch in and switch out of the light path in a mating manner; and the displacement of the color temperature compensation sheet 4 switching in the light path is less than the displacement of the dimming sheet switching in the light path, and the displacement is correspondingly a distance of the color temperature compensation sheet 4 or the dimming sheet getting in and out of the light path relative to the optical axis. The system further comprises a reflector cup 2, and the color temperature compensation sheet 4 is arranged at a position between the focus on which the light source 1 is first focused and the reflector cup 2. Such configuration can avoid optical imaging of the color temperature compensation sheet. In this embodiment, in order to reduce the size of the color temperature compensation sheet 4, the color temperature compensation sheet 4 is arranged at a position close to the light source 1 and away from the focus on which the light source 1 is first focused.

When the light emitted by the light source 1 is reflected by the reflector cup 2 and propagate in the direction of the optical axis, and the luminance of the light is adjusted by the dimming element 3, the color temperature compensation sheet 4 will perform color temperature compensation. The displacement of the color temperature compensation sheet 4 switching in and switching out of the light path is a distance of the color temperature compensation sheet 4 getting in and out of the light path relative to the optical axis. For simplicity, some optical assemblies and the driving mechanism 9 are omitted in FIG. 1.

The color temperature compensation system for a stage light according to the present embodiment, comprising a color temperature compensation sheet 4 and a driving mechanism 9 The driving mechanism 9 is used to control the switch-in and switch-out of the color temperature compensation sheet 4 to compensate, in real time, the color temperature of the light of different luminance emitted by the light source 1, so that the color temperature of the light can remain basically consistent in a dimming process, the stability of the light output quality of the light is thus improved. And the system is simple in structure and convenient to operate.

The driving mechanism 9 comprises a motor and a belt drive element driven by the motor, and the color temperature compensation sheet 4 is arranged on a conveyor belt 6 of the belt drive element. The color temperature compensation sheet 4 comprises a color temperature compensation region 41 and a fixing end 42 which is used to fix the color temperature compensation sheet 4 to the conveyor belt 6. When the motor drives the belt drive element to rotate, the conveyor belt 6 will rotate and drive the color temperature compensation sheet 4 to switch in and switch out of the light path, thus implementing color temperature compensation. Such a driving manner is simple and easy to implement. The color temperature compensation sheet 4 can be switched in and switched out of the light path through forward and reverse rotation of the motor, which is easy to control.

In this embodiment, the belt drive element further comprises a driving wheel and a driven wheel which are sleeved on both ends of the conveyor belt 6, the motor can drive the driving wheel to rotate. Specifically, a drive rotary shaft 5 of the motor is connected to the driving wheel. The color temperature compensation system further comprises an auxiliary sliding element which is slidably connected to the color temperature compensation sheet 4. When the conveyor belt 6 drives the color temperature compensation sheet 4 to move, the color temperature compensation sheet 4 can slide on the auxiliary sliding element, so that the stability of the movement of the color temperature compensation sheet 4 thus can be improved, and the color temperature compensation effect can be further ensured.

In addition, at least one color temperature compensation sheet 4 is provided. When there are two color temperature compensation sheets 4, the driving mechanism 9 is configurated to drive the two color temperature compensation sheets 4 to move toward or away from each other, so that the two color temperature compensation sheets 4 can switch in and switch out of the light path. Such configuration facilitates increasing the switch-in and switch-out speed of the color temperature compensation sheets compared to the case of one color temperature compensation sheet alone. In the present embodiment, two color temperature compensation sheets 4 are provided.

There are mainly two manners of connections among the motor, the belt drive element, and the two color temperature compensation sheets 4. The first manner is that the number of each of the motor and the belt drive element is one, and the two color temperature compensation sheets 4 are respectively arranged on both sides of the conveyor belt 6. Such configuration is convenient for the two color temperature compensation sheets 4 to move at the same speed, and can also simplify the driving mechanism 9, thereby facilitating control and also reducing costs. The second manner is that the number of each of the motors and the belt drive elements is two, and the two color temperature compensation sheets 4 are respectively arranged on the two conveyor belts 6. In the present embodiment, the first manner of connections among the motor, the belt drive element, and the two color temperature compensation sheets 4 is used.

In addition, an installation position of the two color temperature compensation sheets 4 is configured with a height difference, and the two color temperature compensation sheets 4 can partially overlap when the two color temperature compensation sheets 4 move toward each other. Compared with a case where the two color temperature compensation sheets 4 can only be in contact and cannot overlap, partial overlapping of the two color temperature compensation sheets enables color temperature of light at any position on the light path to be compensated, which can avoid a case where the color temperature of the light at the position of a contact line cannot be compensated when the two color temperature compensation sheets 4 are in contact in parallel, such case can further further affect the color temperature compensation effect.

The color temperature compensation sheet 4 uses the same hue as a reference color, and performs color temperature by increasing or decreasing compensation on the light passing therethrough based on a change of color value of the reference color. In this embodiment, the color temperature compensation sheet 4 performs color temperature by increasing compensation on the light passing therethrough based on a change in the color value of blue, or the color temperature compensation sheet performs color temperature by decreasing compensation on the light passing therethrough based on a change in the color value of yellow. Certainly, the reference color selected for color temperature increase compensation is not limited to blue, and the reference color selected for color temperature decrease compensation is not limited to yellow.

In addition, the color temperature compensation sheet 4 is perpendicular to an optical axis.

The change in the color value of the color temperature compensation sheet 4 is a uniform change to simplify the design and production process of the color temperature compensation sheet 4; and the driving mechanism 9 can control, according to a dimming speed, the moving speed of the color temperature compensation sheet 4 during the color temperature compensation sheet switch-in and switch-out of the light path.

Figure 4:
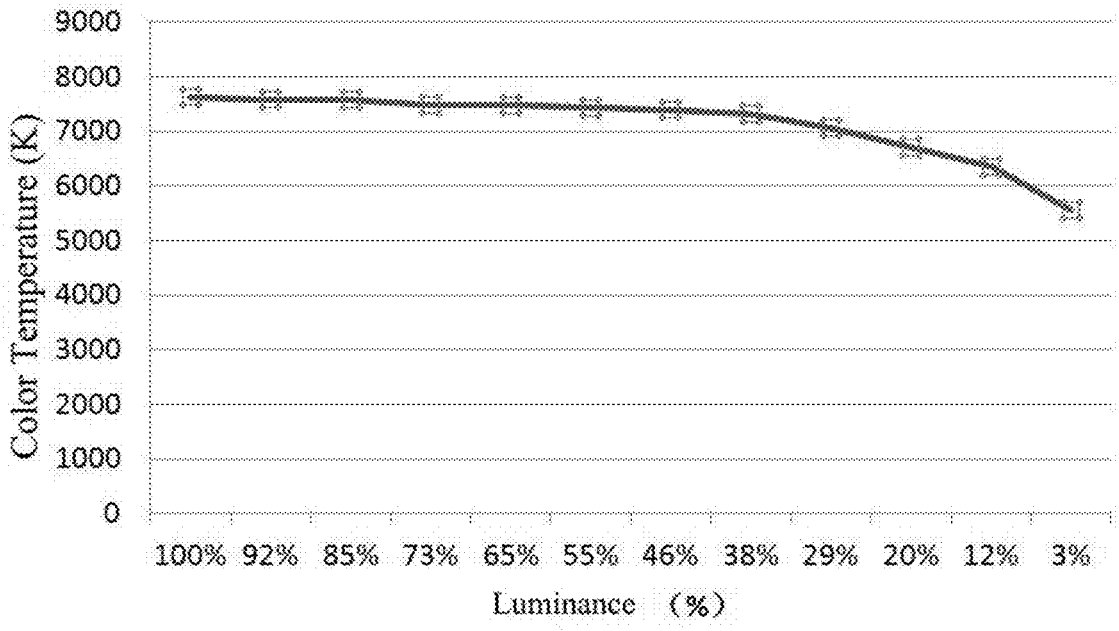
FIG. 4 is a color temperature and luminance change curve before using the color temperature compensation system according to the Embodiment.
Figure 5:
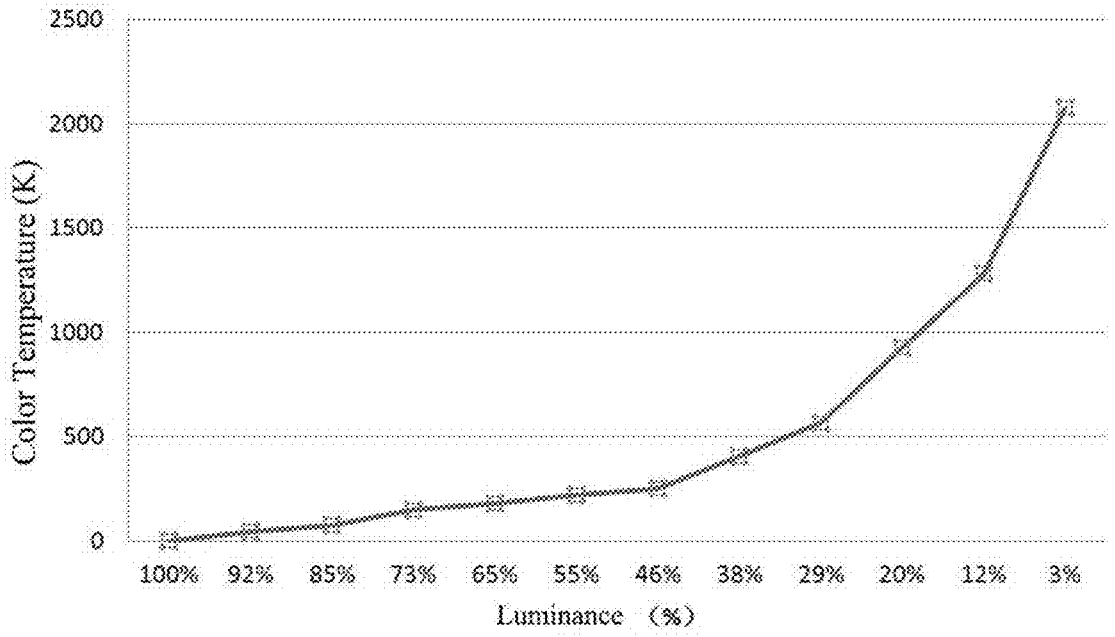
FIG. 5 is a color temperature compensation curve calculated according to the color temperature and luminance change curve according to the Embodiment.

This embodiment further provides a color temperature compensation method for a stage light, which uses the above-mentioned color temperature compensation system and comprises the following steps:

S1. selecting the model of a stage light with a color temperature to be compensated;

S2. before the color temperature compensation system is used, testing, by means of an illuminometer, a relationship between the luminance of output light of the stage light and a change in the color temperature, dimming the prototype of the stage light of the applied model, and obtaining a color temperature and luminance change curve by testing an output light effect which is, shown in FIG. 4; and taking a certain luminance value as a compensation termination point, wherein in this example, the luminance of 3% is taken as the compensation termination point and no compensation is performed on a part less than 3%, and therefore, a dimming range is 100% to 3%;

S3. obtaining a color temperature compensation curve according to the color temperature and luminance change curve, as shown in FIG. 5, and determining that increase compensation is needed in the process of reducing the luminance of the stage light during dimming, and calculating a maximum color temperature compensation value to be 2100 K. In this embodiment, two color temperature compensation sheets 4 are used to perform color temperature compensation, the reference color of the color temperature compensation regions 41 of the two color temperature compensation sheets 4 is designed to be blue accordingly, and a total color value change range is the color temperature increase of 2100 K.

S4. designing a spatial position of the color temperature compensation sheet 4 on a light path according to a spatial structure of the stage light, determining the size of the color temperature compensation sheet 4, designing, according to the size, the reference color, and the color value change range of the color temperature compensation sheet 4, the color value of blue on a single color temperature compensation region 41 to change evenly from 0 to 2100 K. Noting that the direction is changed from the light to the deep and from the position close to the optical axis to the position away from the optical axis, wherein the two color temperature compensation sheets are symmetrically designed.

S5. determining, according to the color temperature compensation curve, a color temperature compensation value required under different luminance conditions, and determining, according to the change in color value and size of the color temperature compensation sheet 4 and the spatial position thereof on the light path, a displacement value of the color temperature compensation sheet 4 under different luminance conditions, which can be used as reference data for controlling a moving distance of the driving mechanism 9.

S6. installing the color temperature compensation sheet 4 on the driving mechanism 9 and installing same into the detected stage light, and in the present invention, controlling the movement of the driving mechanism 9 according to the color temperature compensation curve shown in FIG. 5, then adjusting the displacement value of the color temperature compensation sheet 4 according to the output light effect, and recording the distance for which the color temperature compensation sheet 4 should move when the dimming sheet is at different positions.

S7. after the stage light is started, the driving mechanism 9 controlling, according to the displacement value of the color temperature compensation sheet 4 under different luminance conditions, the two color temperature compensation sheets 4 to switch in and switch out of the light path, thereby completing the color temperature compensation process.

Figure 6:
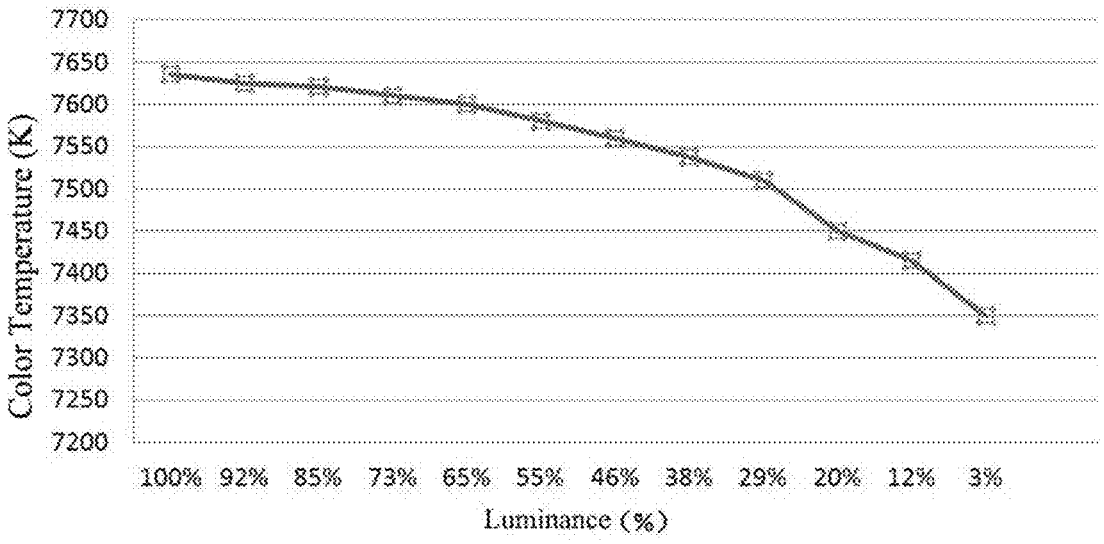
FIG. 6 is a color temperature and luminance change curve after using the color temperature compensation system according to the Embodiment.

According to the output light effect of the stage light after using the color temperature compensation system, the test data is obtained as shown in Table 1, and a new color temperature and luminance change curve is obtained as shown in FIG. 6. It can be seen from Table 1 that the range of the color temperature with the change in luminance can be controlled within 300 K.

When the above-mentioned step S2 is performed, the dimming range is generally 100% to 0%, and for the color temperature compensation process, the low luminance part during dimming is not significant in actual use and the color temperature changes greatly. Therefore, a certain luminance value may be taken as a compensation termination point according to actual situations.

In addition, when the above-mentioned step S3 is performed, the reference color is not limited to blue, and other cool colors may be used.

When the above-mentioned step S3 is performed, the maximum color temperature compensation value can be appropriately increased, and a margin can be retained, which can avoid the case where a color temperature compensation range in use of the stage light is insufficient.

In addition, when the above-mentioned step S4 is performed, the position of the color temperature compensation sheet 4 in the optical axis direction from the light source 1 and the dimming sheet should be as close to the dimming sheet as possible, which can reduce the size of the color temperature compensation sheet 4.

When the above-mentioned step S6 is performed, due to the impact of the color temperature compensation sheet 4 on luminance, the color temperature compensation value should be appropriately eased within the luminance standard range, and it is preferable that the luminance reaches a standard.

TABLE 1

| Test data | | | | | | | | | | | | |
|---|---|---|---|---|---|---|---|---|---|---|---|---|
| Displacement of dimming sheet | 0% | 15% | 25% | 36% | 46% | 59% | 65% | 72% | 78% | 82% | 86% | 90% |
| Luminance value (LUX) | 11480 | 10580 | 9795 | 8415 | 7386 | 6395 | 5365 | 4426 | 3411 | 2386 | 1359 | 330 |
| Displacement of color temperature compensation sheet | 0% | 5% | 11% | 20% | 29% | 42% | 51% | 63% | 71% | 80% | 92% | 100% |
| Color temperature value (K) | 7636 | 7625 | 7621 | 7610 | 7600 | 7580 | 7560 | 7538 | 7510 | 7450 | 7414 | 7350 |

Embodiment II

Embodiment II is different from Embodiment I in that the change in color value of the color temperature compensation sheet 4 is not a uniform change. That is, the color value thereof varies according to the change in the color temperature compensation value required by the light source 1 under different luminance conditions, which is a non-uniform change. The driving mechanism 9 controls, according to a dimming speed, the moving speed of the color temperature compensation sheet 4 during the color temperature compensation sheet switch-in and switch-out of the light path.

According to Embodiment II, the drive rotary shaft 5 rotates at a uniform speed so as to control the two color temperature compensation sheets 4 to move, and only the directions of the color temperature compensation sheets 4 switching in and switching out of the light path and the displacement values of the color temperature compensation sheets need to be controlled in the control process.

Embodiment III

Embodiment III is different from Embodiment I in that the light source 1 is an LED light source, and the dimming element 3 of the LED light source uses electronic dimming.

Obviously, the above embodiments of the present invention are merely embodiments used for clearly describing the present invention, instead of limiting the implementations of the present invention. For a person of ordinary skill in the art, other forms of changes or variations may also be made on the basis of the above-mentioned illustration. There is no need and no way to exhaust all implementations here. Within the spirit and principle of the present invention, any modifications, equivalent replacements, improvements, etc., shall be comprised within the scope of protection of the present invention.

The invention claimed is:

1. A color temperature compensation system for a stage light, comprising a light source; and a dimming element for dimming the light source, and further comprising a color temperature compensation sheet for performing color temperature compensation on light output from the dimming element; and a driving mechanism for controlling the movement of the color temperature compensation sheet, wherein there are changes in color value on the color temperature compensation sheet, and the driving mechanism is configured to drive the color temperature compensation sheet to switch in and switch out of a light path so as to implement color temperature compensation.

2. The color temperature compensation system for a stage light according to claim 1, wherein the driving mechanism comprises a motor; and a belt drive element driven by the motor, wherein the color temperature compensation sheet is arranged on a conveyor belt of the belt drive element.

3. The color temperature compensation system for a stage light according to claim 2, wherein the belt drive element further comprises a driving wheel driven to rotate by the motor; and a driven wheel, the driving wheel and the driven wheel being sleeved on both ends of the conveyor belt, and wherein the color temperature compensation system further comprises an auxiliary sliding element which is slidably connected to the color temperature compensation sheet.

4. The color temperature compensation system for a stage light according to claim 1, wherein two color temperature compensation sheets are provided, and the driving mechanism is configured to drive the two color temperature compensation sheets to move toward or away from each other to switch in and switch out of the light path.

5. The color temperature compensation system for a stage light according to claim 4, wherein the number of each of the motor and the belt drive element is one, and the two color temperature compensation sheets are respectively arranged on both sides of the conveyor belt;

or wherein the number of each of the motor and the belt drive element is two, and the two color temperature compensation sheets are respectively arranged on the two conveyor belts.

6. The color temperature compensation system for a stage light according to claim 4, wherein an installation position of the two color temperature compensation sheets is configured with a height difference, and the two color temperature compensation sheets are able to partially overlap when the two color temperature compensation sheets move toward each other.

7. The color temperature compensation system for a stage light according to claim 1, wherein the color temperature compensation sheet uses a same hue as a reference color, and is configured to perform color temperature by increasing or decreasing compensation on the light passing therethrough based on a change in color value of the reference color.

8. The color temperature compensation system for a stage light according to claim 7, wherein the color temperature compensation sheet is further configured to perform color temperature by increasing compensation on the light passing therethrough based on a change in the color value of blue, or wherein the color temperature compensation sheet performs color temperature by decreasing compensation on the light passing therethrough based on a change in the color value of yellow.

9. The color temperature compensation system for a stage light according to claim 7, wherein the color temperature compensation sheet is perpendicular to an optical axis of the stale light.

10. The color temperature compensation system for a stage light according to claim 7, wherein the change in the color value of the color temperature compensation sheet is uniform; or the change in the color value of the color temperature compensation sheet is varied according to a color temperature compensation value required by the light source under different luminance conditions; and Wherein the driving mechanism is able to control the moving speed of the color temperature compensation sheet during the color temperature compensation sheet switch-in and switch-out of the light path according to a dimming speed.

11. The color temperature compensation system for a stage light according to claim 1, wherein the light source is a traditional light source, the dimming element of the traditional light source is a dimming sheet arranged between the color temperature compensation sheet and the light source, and wherein the dimming sheet performs shielding dimming on the light passing therethrough by means of switch-in and switch-out of the light path;

or wherein the light source is an LED light source, and the dimming element of the LED light source is electronic.

12. The color temperature compensation system for a stage light according to claim 11, wherein when the light source is a traditional light source, the dimming sheet and the color temperature compensation sheet are arranged on the same driving mechanism; and wherein a displacement of the color temperature compensation sheet switching in the light path is less than a displacement of the dimming sheet switching in the light path, and the displacement is correspondingly a distance of the color temperature compensation sheet or the dimming sheet getting in and out of the light path relative to an optical axis.

13. The color temperature compensation system for a stage light according to claim 1, wherein the system further comprises a reflector cup, and the color temperature compensation sheet is arranged between the reflector cup and a focus on which the light source is first focused.

14. A color temperature compensation method for a stage light, wherein the method uses the color temperature compensation system according to claim 1 and comprises the following steps:

S1. selecting the model of a stage light with a color temperature to be compensated;

S2. testing a change in the luminance of output light in a dimming process of the stage light and testing the corresponding change in color temperature according to the luminance of output light, and recording a maximum value by which the color temperature deviates from a standard color temperature, namely, a maximum color temperature compensation value;

S3. designing a color value change range of the color temperature compensation sheet according to the maximum color temperature compensation value and a relationship between the change in the color temperature and the change in the luminance of output light, and selecting a reference color according to required increase or decrease compensation of color temperature;

S4. designing a spatial position of the color temperature compensation sheet on a light path according to a spatial structure of the stage light and determining the size of the color temperature compensation sheet, and designing a change in the color value on the color temperature compensation sheet according to the size, the number, the color value change range and the reference color of the color temperature compensation sheet;

S5. determining a color temperature compensation value required under different luminance conditions according to the relationship between the change in the color temperature and the change in the luminance of output light, and determining a displacement value of the color temperature compensation sheet switching in and switching out of the light path under different luminance conditions according to the change in the color value and the size of the color temperature compensation sheet, and the spatial position of the color temperature compensation sheet in the light path; and S6. the driving mechanism controlling the movement of color temperature compensation sheet according to the displacement value of the color temperature compensation sheet under different luminance conditions.

* * * * *